US007575103B2

(12) United States Patent
Chiba

(10) Patent No.: US 7,575,103 B2
(45) Date of Patent: Aug. 18, 2009

(54) ELEVATOR SUPERVISORY SYSTEM FOR MANAGING OPERATING CONDITION DATA

(75) Inventor: Yuji Chiba, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 540 days.

(21) Appl. No.: 10/574,606

(22) PCT Filed: Aug. 11, 2004

(86) PCT No.: PCT/JP2004/011547

§ 371 (c)(1),
(2), (4) Date: Apr. 5, 2006

(87) PCT Pub. No.: WO2006/016405

PCT Pub. Date: Feb. 16, 2006

(65) Prior Publication Data

US 2007/0012523 A1 Jan. 18, 2007

(51) Int. Cl.
*B66B 1/34* (2006.01)

(52) U.S. Cl. ..... 187/394; 187/247

(58) Field of Classification Search ..... 187/247, 187/248, 391–396; 340/502, 503, 514–516, 340/539.1, 539.14, 3.1, 815.81; 706/909, 706/910, 918

See application file for complete search history.

(56) References Cited

U.S. PATENT DOCUMENTS

| | | | | | |
|---|---|---|---|---|---|
| 3,973,648 | A * | 8/1976 | Hummert et al. | ..... | 187/393 |
| 4,622,538 | A * | 11/1986 | Whynacht et al. | ..... | 340/506 |
| 4,698,780 | A * | 10/1987 | Mandel et al. | ..... | 187/393 |
| 4,930,604 | A * | 6/1990 | Schienda et al. | ..... | 187/393 |
| 6,863,161 | B2 * | 3/2005 | Mearns et al. | ..... | 187/391 |
| 7,419,032 | B2 * | 9/2008 | Yamakawa | ..... | 187/247 |
| 2007/0261924 | A1 * | 11/2007 | Lindberg et al. | ..... | 187/391 |

FOREIGN PATENT DOCUMENTS

| | | | |
|---|---|---|---|
| CN | 1439146 | A | 8/2003 |
| JP | 04089780 | A * | 3/1992 |
| JP | 8-151176 | | 6/1996 |
| JP | 11228046 | A * | 8/1999 |
| JP | 2000-351546 | | 12/2000 |
| JP | 2002-241060 | | 8/2002 |
| JP | 2003192248 | A * | 7/2003 |
| JP | 2003-267641 | | 9/2003 |
| JP | 2004-502251 | | 1/2004 |
| JP | 2004-189358 | | 7/2004 |
| JP | 2005-1864 | | 1/2005 |
| WO | WO 02/01509 | A2 | 1/2002 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

An elevator supervisory system capable of managing abnormality data, operating condition data and car interior video data in association with one another, so that this data can be displayed in association with one another upon the occurrence of an abnormality.

3 Claims, 6 Drawing Sheets

FIG. 2

23 : SYSTEM PARAMETER TABLE

| MANAGEMENT NUMBER | BANK NAME | STOP FLOOR NUMBER | PRODUCTION COMPANY |
|---|---|---|---|
| E001 | FIRST BANK | 10 | COMPANY A |
| E002 | FIRST BANK | 9 | COMPANY A |
| E003 | FIRST BANK | 9 | COMPANY A |
| E004 | FIRST BANK | 9 | COMPANY A |
| E005 | SECOND BANK | 5 | COMPANY B |
| E006 | SECOND BANK | 7 | COMPANY B |
| E007 | SECOND BANK | 7 | COMPANY B |

FIG. 3

25 : SUPERVISORY DATA TABLE

| MEMORY ADDRESS | EN | MANAGE-MENT NUMBER | BANK NAME | DATE AND TIME | CAR POSITION | DIRECTION OF OPERATION | DOOR | OPERATED/ STOPPED | NORMAL/ ABNORMAL | VIDEO CODE |
|---|---|---|---|---|---|---|---|---|---|---|
| | | OPERATING CONDITION DATA | | | | | | | | |
| E001 i:1 | E003 | E002 | E003 | E002 | E003 | E002 | E003 | E002 | E003 | E002 |
| E001 | 1 | 1 | 1 | 1 | 3 | UP | OPENED | OPERATION | NORMAL | G1 |
| | | | 03-06-01 07-00-00 | 03-06-01 | 4 | | | | | |
| 2 | E001 | 1 | 03-06-01 07-00-01 | 03-05-01 | 3 | UP | OPENED | OPERATION | NORMAL | G1 |
| | | | | | 4 | | | | | |
| 3 | E001 | 1 | 03-06-01 07-00-02 | 2 | UP | OPENED | OPERATION | NORMAL | G2 | 2 |
| | | | | | | | | | | |
| | | | | 2 | UP | OPENED | OPERATION | NORMAL | G3 | 3 |
| | | | | | | | | | | |
| | | | | 2 | UP | CLOSED | OPERATION | NORMAL | | 4 |
| | | | | | | | | | | |
| 11 | E001 | 1 | 03-06-01 07-00-10 | 3 | UP | CLOSED | OPERATION | NORMAL | G11 | 2 |
| | | | | | | | | | | |
| 12 | E001 | 1 | 03-06-01 | 3 | UP | CLOSED | OPERATION | NORMAL | G12 | 3 |
| | | | | | | | | | | |
| .... | | | | | | | | | | |

FIG. 4

EXAMPLE OF DATA MANAGEMENT

| MANAGEMENT NUMBER | TIME POINT | ERROR CODE | CONTENT OF ERROR |
|---|---|---|---|
| E001 | 12:00 ~13:00 | E0001 | ***ABNORMALITY |
| | | | |

ELEVATOR SUPERVISORY SYSTEM FOR MANAGING OPERATING CONDITION DATA

TECHNICAL FIELD

The present invention relates to an elevator supervisory system which is capable of recording and accumulating videos taken by cameras installed in elevator cars together with their date and time information, and enabling desired video data to be acquired from an accumulation data table upon occurrence of an abnormality of an elevator.

BACKGROUND ART

In the past, an elevator supervisory system for supervising and controlling elevators has separate supervisory or monitoring devices provided in accordance with objects to be monitored, respectively, so that the supervision of the elevators is carried out by elevator supervisory devices, and the monitoring of the interiors of elevator cars is carried out by car interior monitoring devices (see, for instance, a first patent document).

[First Patent Document] Japanese patent application laid-open No. 2000-351546

DISCLOSURE OF THE INVENTION

[Problems to be Solved by the Invention]

However, the elevator supervisory system having all the monitoring and supervisory functions as referred to above should start up separate tools for individual monitoring and supervisory functions, respectively, and perform individual operations separately, so if one wants to grasp the interior state of an elevator car, for example, it is necessary to watch an elevator supervisory device and at the same time to watch a car interior monitoring device as well so as to grasp the car interior state at that time, thus posing a problem that operation efficiency becomes low.

In addition, since it is necessary to provide a personal computer for each tool, and it is also necessary to provide a special monitor dedicated for the videos of car interiors, there is another problem of requiring a lot of installation spaces.

Further, in the case of a system that receives abnormality data and displays videos of car interiors upon occurrence of an abnormality of an elevator, it is necessary to arrange users or operators for individual monitors, respectively, so as to grasp the situations or states at the same time, thus giving rise a problem of increased costs.

[Means for Solving the Problems]

The present invention includes: a supervisory server for concentratedly managing operating condition data, car interior video data and abnormality data of an elevator in association with one another; and a supervisory terminal device and a monitor that are connected to the supervisory server through a network. The operating condition data is data in which a car position of the elevator or an operating condition representative of normality/abnormality thereof is recorded together with date and time information at predetermined time intervals. The car interior video data is data in which videos of the interior of a car of the elevator related to the operating condition data are recorded. The supervisory server manages, upon occurrence of an abnormality in the elevator, the abnormality data, the operating condition data and the car interior video data in association with one another. The supervisory terminal device takes in the operating condition data, the car interior video data or the abnormality data from the supervisory server through the network and displays them on the monitor.

[Effects of the Invention]

According to the present invention, abnormality data, operating condition data and car interior video data are managed in association with one another, so that the abnormality data, the operating condition data and the car interior video data can be displayed in association with one another upon occurrence of an abnormality of an elevator.

BRIEF DESCRIPTION OF THE DRAWINGS

FIG. 2 is an explanatory view showing the content of a system parameter table 23 in FIG. 1 (Embodiment 1).

FIG. 3 is an explanatory view showing the content of a supervisory data table 25 in FIG. 1 (Embodiment 1).

FIG. 4 is an explanatory view showing the content of a supervisory video data table 29 in FIG. 1 (Embodiment 1).

BEST MODE FOR CARRYING OUT THE INVENTION

Accordingly, the present invention is intended to obviate the problems as referred to above, and has for its object to obtain an elevator supervisory system which is capable of managing abnormality data, operating condition data and car interior video data in association with one another, so that the abnormality data, the operating condition data or the car interior video data can be displayed in association with one another upon occurrence of an abnormality of an elevator.

EMBODIMENT 1

Figure 1:
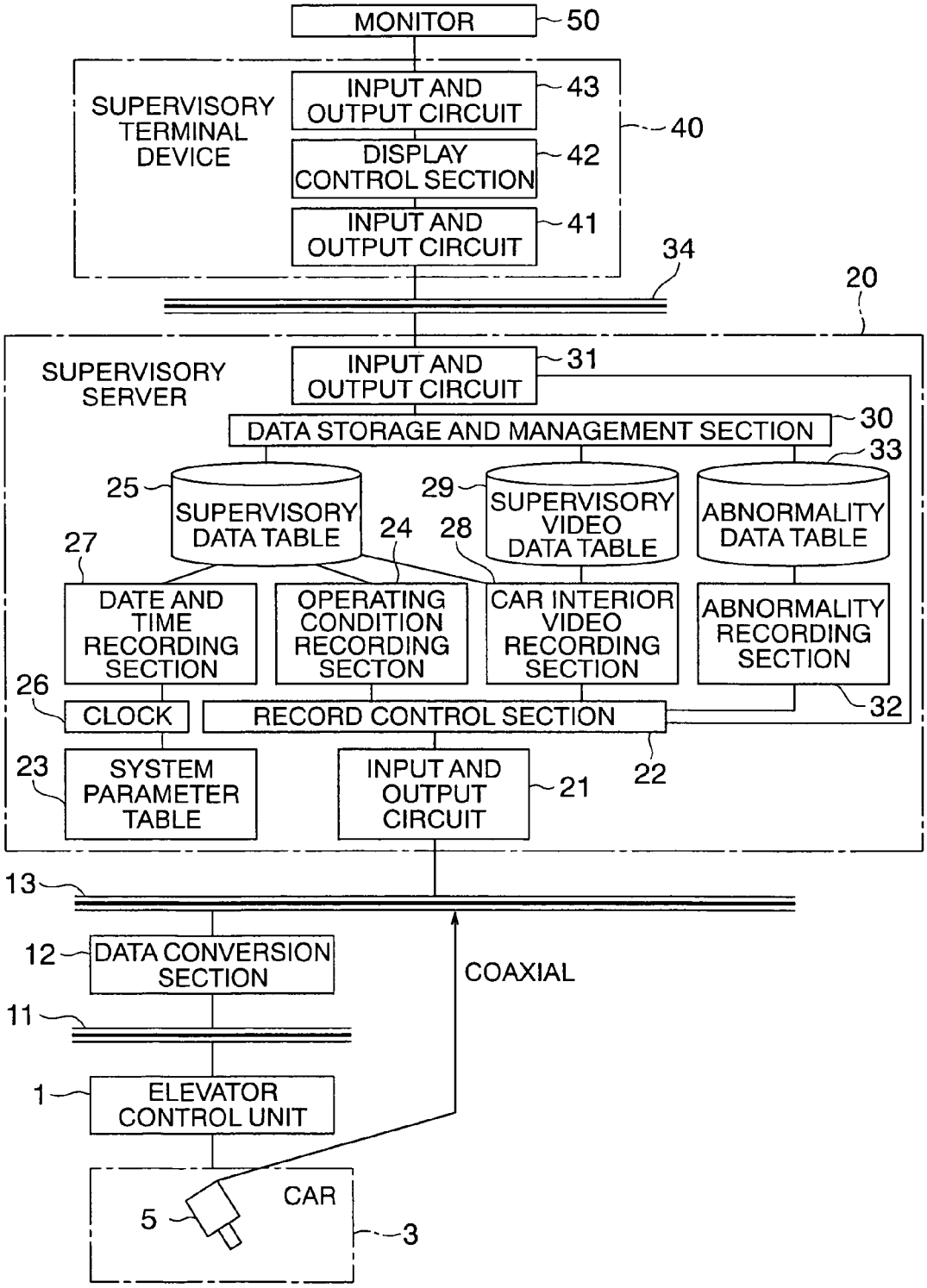
FIG. 1 is a block diagram showing an elevator supervisory system according to a first embodiment of the present invention (Embodiment 1).

FIG. 1 is a block diagram the shows an elevator supervisory system according to a first embodiment of the present invention.

In FIG. 1, the elevator supervisory system includes an elevator control unit 1, a car 3, a camera 5 installed in the car 3, networks 11, 13, 34, a data conversion section 12, a supervisory server 20, a supervisory terminal device 40, and a monitor 50.

The network 11 serves to connect the elevator control unit 1 and the data conversion section 12 to each other.

The data conversion section 12 serves to convert data input to and output from the elevator control unit 1 into a predetermined format for easy handling.

The network 13 serves to connect the data conversion section 12 and the supervisory server 20 to each other so as to perform data transmission between the elevator control unit 1 and the supervisory server 20.

Also, the network 13 is connected to the camera 5 through a coaxial cable, so that videos from the camera 5 installed in the car 3 are transmitted to the supervisory server 20.

The supervisory server 20 includes an input and output circuit 21 connected to the network 13, a record control section 22 connected to the input and output circuit 21, a system parameter table 23, an operating condition recording section 24, a supervisory data table 25, a clock 26, a date and time recording section 27, a car interior video recording section 28, a supervisory video data table 29, a data storage and management section 30, an input and output circuit 31 connected to the network 34, an abnormality recording section 32, and an abnormality data table 33.

In the supervisory server 20, the system parameter table 23, the operating condition recording section 24, the clock 26, the date and time recording section 27, the car interior video recording section 28, the input and output circuit 31, and the abnormality recording section 32 are connected to the record control section 22.

The operating condition recording section 24, the date and time recording section 27, the car interior video recording section 28, and the data storage and management section 30 are connected to the supervisory data table 25.

The car interior video recording section 28 and the data storage and management section 30 are connected to the supervisory video data table 29.

Also, the abnormality recording section 32 and the data storage and management section 30 are connected to the abnormality data table 33.

Further, the input and output circuit 31 is connected to the data storage and management section 30.

The supervisory server 20 acquires operating condition data from the elevator control unit 1 through the network 13 and the input and output circuit 21 at fixed intervals, stores the content of control on the elevator control unit 1, and receives the date of car interior video taken by the camera 5.

In the system parameter table 23, a bank name, a stop floor number, etc., corresponding to each elevator are described.

The record control section 22 sends the operating condition data received through the input and output circuit 21 to the operating condition recording section 24 while referring to the system parameter table 23.

In addition, simultaneously with this, the record control section 22 sends the operating condition data to the supervisory terminal device 40 through the input and output circuit 31 and the network 34.

The operating condition recording section 24 sends and records the operating condition data received from the record control section 22 to the supervisory data table 25 in the predetermined format.

Also, the record control section 22 reads out current date and time information from the clock 26, and sends it to the date and time recording section 27.

In response to this, the date and time recording section 27 sends and records the date and time information received from the record control section 22 to the supervisory data table 25 in the predetermined format.

Moreover, the record control section 22 sends the car interior video data received from the camera 5 through the input and output circuit 21 to the car interior video recording section 28.

In response to this, the car interior video recording section 28 allocates the video data to a video code on the basis of the car interior video data received from the record control section 22, sends the video code to the supervisory data table 25 and the supervisory video data table 29 in the predetermined format, sends and records the video data to the supervisory video data table 29 in the predetermined format.

Further, the record control section 22 sends the abnormality data received through the input and output circuit 21 to the abnormality recording section 32, and at the same time to the supervisory terminal device 40 through the input and output circuit 31 and the network 34.

In response to this, the abnormality recording section 32 sends and records the abnormality data received from the record control section 22 to the abnormality data table 33 in the predetermined format.

The data storage and management section 30 acquires operating condition data and video codes recorded in the supervisory data table 25 according to an instruction from the supervisory terminal device 40, acquires car interior video data and video codes from the supervisory video data table 29, as well as abnormality data from the abnormality data table 33, and sends the acquired video data and video codes to the supervisory terminal device 40 through the input and output circuit 31 and the network 34.

The supervisory terminal device 40 is provided with an input and output circuit 41 connected to the network 34, an input and output circuit 43 connected to the monitor 50, and a display control section 42 interposed between the input and output circuit 41 and the input and output circuit 43.

The input and output circuit 41 inputs and outputs data to and from the supervisory server 20, and the input and output circuit 43 inputs and outputs data to and from the monitor 50.

The display control section 42 performs display control on the monitor 50 in accordance with an instruction from the monitor 50.

The monitor 50 also functions as an input terminal for a user to perform the setting of designation of a desired display screen. For instance, when a symbol (to be described later) indicating an abnormality in the screen of the monitor 50 is clicked by the user, an acquisition request for the management number of an abnormality generation car is created to the data storage and management section 30 through the supervisory terminal device 40.

In addition, the monitor 50 also functions as an input terminal for the user to designate a desired piece of date and time information. For instance, the user becomes able to designate data from a search start date and time to a search end date and time.

Further, the monitor 50 constitutes, in association with the supervisory terminal device 40, an input section by which the user becomes able to designate the date and time information from the start to the end of the search of abnormality data as well as date and time information indicating the point in time of the occurrence of an abnormality of an elevator.

Next, further specific reference will be made to the operation of the elevator supervisory system according to the first embodiment of the present invention shown in FIG. 1 while referring to a flow chart in FIG. 5 together with explanation views of FIGS. 2 through 4 and 6.

FIG. 2 shows an example of data of the system parameter table 23, in which bank names (first bank, second bank, . . . ), stop floor numbers (10th floor, 9th floor, . . . ), and production companies (company A, company B, . . . )are shown in association with management numbers (E001, E002, . . . ), respectively.

FIG. 3 shows an example of data of the supervisory data table 25, in which bank names, dates and times, car positions (2nd floor, 3rd floor, . . . ), direction of operation (UP, DOWN), door opened/closed state, operated/stopped state, normal/abnormal state, and video code (G1, G2, . . . ) are shown for memory addresses (E001, E002, . . . , EN) corresponding to management numbers, respectively.

FIG. 4 shows an example of data management of the supervisory video data table 29, in which there are shown time points, error codes, and error contents (abnormality, etc., ) corresponding to management numbers, respectively.

Figure 5:
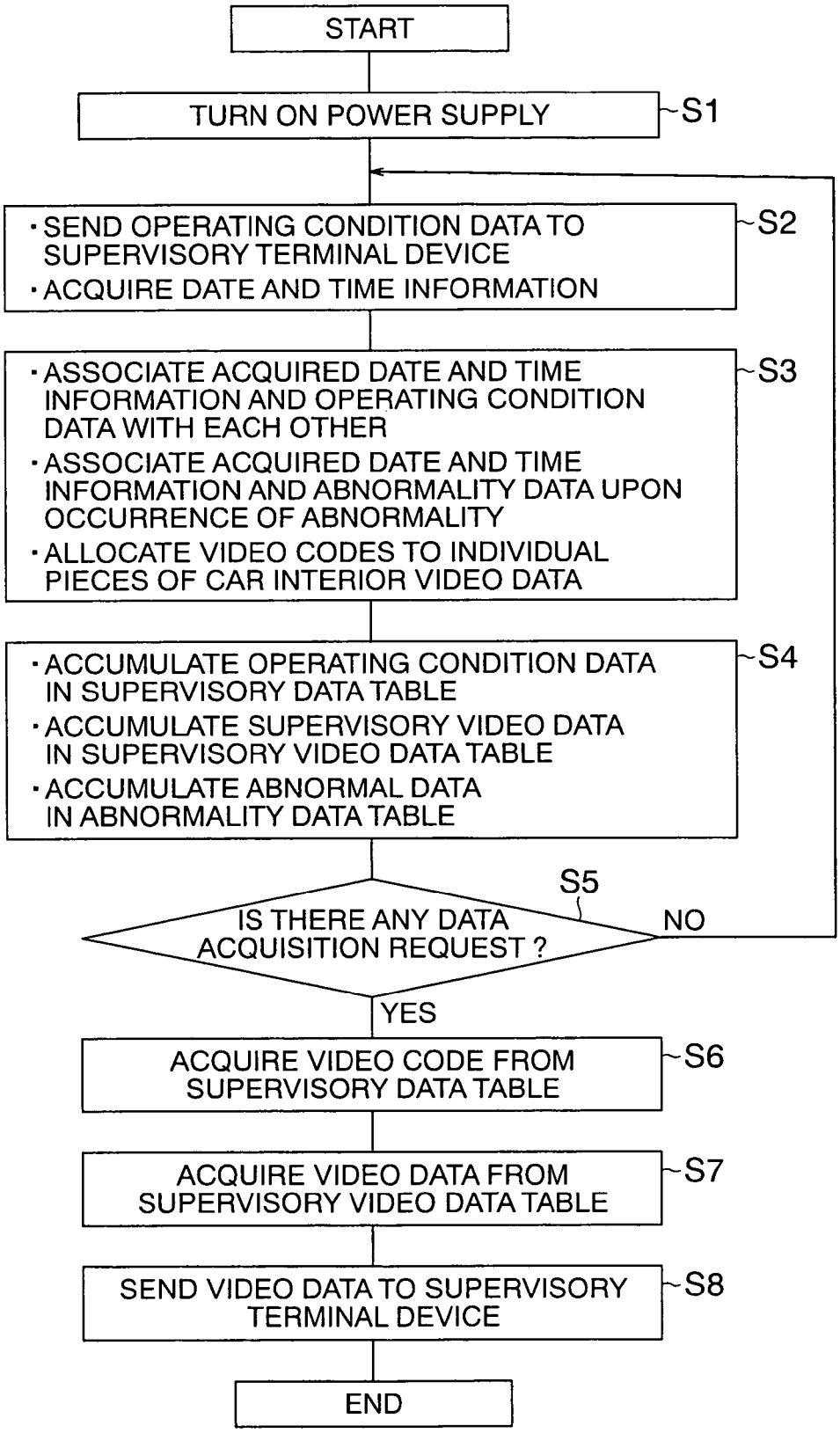
FIG. 5 is a flow chart illustrating a specific operation of the elevator supervisory system according to the first embodiment of the present invention (Embodiment 1).

FIG. 5 illustrates a display processing procedure with respect to the monitor 50, in which the state of the car 3 is displayed, and at the same time, car interior video data is artificially displayed by user's designation when an abnormality occurs.

Figure 6:
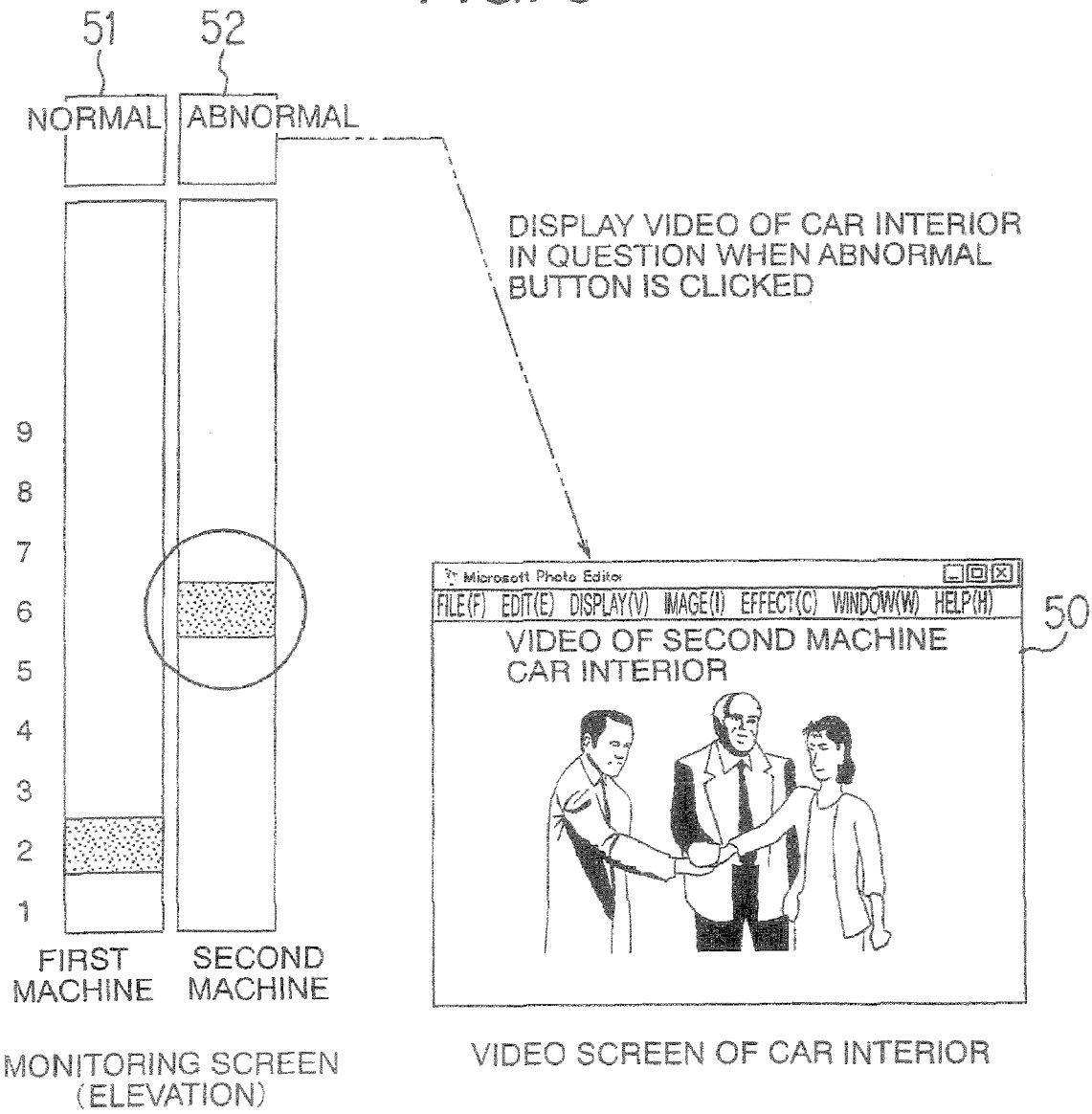
FIG. 6 is an explanatory view showing a display operation of the elevator supervisory system upon occurrence of an abnormality according to the first embodiment of the present invention (Embodiment 1).

FIG. 6 shows one example of the car interior video data upon occurrence of an abnormally, in which among two elevator cars, a first machine is normal and an abnormality has occurred in a second machine.

In the case of FIG. 6, the elevations of the respective machines are displayed on the monitor 50 as a supervisory or monitoring screen, with a symbol 51 representative of normality and a symbol 52 representative of abnormality being displayed corresponding to the respective machines.

In FIG. 6, there is shown a state in which by user's clicking the symbol 52 (abnormal button) representative of abnormality, the video of the car interior of the second machine in which an abnormal has occurred is displayed.

In FIG. 5, first of all, after power supply is turned on (step S1), the supervisory server 20 sends operating condition data to the supervisory terminal device 40, and in the record control section 22, date and time information is acquired from the clock 26 (step S2).

At this time, the elevator control unit 1 sends the operating condition data of each car 3 (the position of each car, the opened/closed state of each door, etc.,) to the data conversion section 12 through the network 11, and the data conversion section 12 inputs the operating condition data to the supervisory server 20 after converting it into a format that is able to be handled by the supervisory server 20.

Subsequently, by using the acquired date and time information, the record control section 22 associates the operating condition data with the date and time information (step S3), and accumulates the data thus associated in the supervisory data table 25 through the operating condition recording section 24 and the date and time recording section 27 (step S4).

Here, note that at the time of occurrence of an abnormality, abnormality data is associated with its date and time information (step S3), and the data thus associated is accumulated in the abnormality data table 33 through the abnormality recording section 32 (step S4).

In addition, simultaneously with this, the record control section 22 receives car interior video data from the camera 5 installed in each car 3, and allocates a video code to video data in each car, as in the case of the operating condition data (step S3).

At this time, the camera 5, functioning as a video supervisory unit in each car, sends current car interior video data to the elevator supervisory server 20 at predetermined periods.

Subsequently, the record control section 22 writes a video code corresponding to the date and time information into the supervisory data table 25 through the car interior video recording section 28, and at the same time accumulates the video code and the video data in the supervisory video data table 29 while associating them each other (step S4).

Here, note that the data to be written into the individual data tables 25, 29 and 33 are accumulated in units of a fixed period.

Then, the data storage and management section 30 in the supervisory server 20 determines whether a data acquisition request is input from a supervisory terminal device 40 side (step S5), and when it is determined that there is no data acquisition request (that is, NO), a return to step S2 is carried out, and the above-mentioned processing steps S2 through S5 are repeated.

On the other hand, when it is determined in step S5 that there is a data acquisition request (that is, YES), the data storage and management section 30 acquires a video code corresponding to the data acquisition request from the supervisory data table 25 (step S6), acquires car interior video data from the supervisory video data table 29 (step S7), sends the car interior video data to the supervisory terminal device 40 (step S8), and terminates the processing routine of FIG. 5.

For instance, in FIG. 6, when the symbol 52 indicating an abnormality in the screen on which the elevator states are displayed is clicked by the user, a management number acquisition request is created to the data storage and management section 30.

Accordingly, the data storage and management section 30 sends a video code acquired from the supervisory data table 25, car interior video data acquired from the supervisory video data table 29 and abnormality data acquired from the abnormality data table 33 to the supervisory terminal device 40.

As a result, detailed elevator information on the second machine in which an abnormality has occurred can be displayed on the screen of the monitor 50, and at the same time, a car interior video of the second machine can be displayed on the monitor 50, as shown in FIG. 6, whereby the state of the abnormal machine can be verified in a collective manner.

That is, the supervisory server 20 can concentratedly manage elevator operating condition data (car positions, normality/abnormality, etc., ) and car interior video data related to the operating condition data by recording them in association with their date and time information at predetermined time intervals, and at the same time can manage, upon occurrence of an abnormality in an elevator, abnormality data, operating condition data and car interior video data in association with one another.

In addition, it is possible to display on the monitor 50 the operating condition data, the car interior video data, the abnormality data, etc., by taking them in from the supervisory server 20 through the network 34 connected to the supervisory server 20.

Accordingly, the video information on the interiors of the cars 3 can be managed and supervised together with the elevator states in a collective manner, so the time of maintenance can be shortened.

Moreover, by storing and managing the date and time information, the elevator states, and the video information of the interiors of the cars 3 in the supervisory server 20 while associating them with one another, it is possible to monitor or supervise the videos of the interiors of the cars 3 in accordance with the states (conditions) of the elevators, and to supervise the videos of the interiors of the cars 3 together with the elevator states at a designated time.

Accordingly, it is possible to help make an early determination of the occurrence of an abnormality due to a child's prank or the like for example, so an unnecessary operation can be avoided, and improvements in terms of security can be made.

Further, if an abnormality in an elevator occurs when operating condition data (car positions, etc.,) is displayed on the monitor 50, the supervisory terminal device 40 generates a data acquisition request to the data storage and management section 30 in the supervisory server 20 in response to an operation (a click operation of the symbol 52 representative of an abnormality) induced by the user, so that the video data of the interior of a car in which the abnormality has occurred can be displayed on the monitor 50.

As a result, the video of the car interior upon occurrence of the abnormality therein can be displayed on the monitor 50 in an easy manner.

In addition, the video of the interior of a car can be monitored only at the time required of a data acquisition request, so it becomes possible to reduce the load of the supervisory server 20. For instance, it is possible to prevent troubles such as jumped display or the like of the position of a car during its vertical movement on the monitoring screen (elevation) in FIG. 6.

Further, the supervisory terminal device 40 can acquire abnormality data from a search starting date to a search end date designated by the man-induced operation as well as operating condition data and car interior video data at this time from the supervisory server 20 through the network 34, and display on the monitor 50 the operating condition data or the car interior video data of an abnormality occurrence date and time designated by the man-induced operation.

As a result, the state of the elevator upon occurrence of the abnormality can be verified while going back the date and time information to the past, and hence the situation can be quickly determined even in terms of security.

The invention claimed is:

1. An elevator supervisory system comprising:

a supervisory server configured to manage operating condition data, car interior video data and abnormality data of an elevator in association with one another; and a supervisory terminal device and a monitor that are connected to said supervisory server through a network, wherein said operating condition data comprises data in which a car position of said elevator and an operating condition representative of normality/abnormality thereof are recorded together with date and time information at predetermined time intervals, said car interior video data comprises data in which videos of the interior of a car of said elevator related to said operating condition data are recorded, said supervisory server manages, upon occurrence of an abnormality in said elevator, said abnormality data, said operating condition data and said car interior video data in association with one another, and said supervisory terminal device receives said operating condition data, said car interior video data or said abnormality data from said supervisory server through said network for display on said monitor.

2. The elevator supervisory system as set forth in claim 1, wherein said supervisory terminal device and said monitor each have an input section including a symbol representative of an abnormality; and when an abnormality has occurred in said elevator during display of said operating condition data on said monitor, said car interior video data is displayed on said monitor in response to a selection of said symbol.

3. The elevator supervisory system as set forth in claim 1, wherein said supervisory terminal device and said monitor each have an input section by which first date and time information from a start to an end of searching said abnormality data and second date and time information representative of a point in time at which an abnormality occurred in said elevator are designated;

abnormality data, operating condition data and car interior video data from said search start to said search end are acquired from said supervisory server through said network in response to a selection designating said first date and time information; and operating condition data and car interior video data at a point in time of occurrence of an abnormality are displayed on said monitor in response to a user's operation of designating said second date and time information.

* * * * *